US008962074B2

(12) United States Patent
Hafner et al.

(10) Patent No.: US 8,962,074 B2
(45) Date of Patent: Feb. 24, 2015

(54) DEVICE AND METHOD FOR APPLYING GLUE

(75) Inventors: Dieter Hafner, Regensburg (DE); Tobias Eichhammer, Bad Abbach (DE); Stephan Rattenberger, Mengkofen (DE)

(73) Assignee: Krones AG (DE)

( * ) Notice: Subject to any disclaimer, the term of this patent is extended or adjusted under 35 U.S.C. 154(b) by 796 days.

(21) Appl. No.: 13/112,906

(22) Filed: May 20, 2011

(65) Prior Publication Data

US 2011/0287179 A1 Nov. 24, 2011

(30) Foreign Application Priority Data

May 21, 2010 (DE) ..... 10 2010 022 190

(51) Int. Cl.

*B05D 5/10* (2006.01)
*B05C 1/02* (2006.01)
*B65C 9/22* (2006.01)
(Continued)

(52) U.S. Cl.

CPC ..... *B65C 9/2269* (2013.01); *B05C 1/0813* (2013.01); *B05C 5/0208* (2013.01); *B05D 1/28* (2013.01); *B05C 5/0204* (2013.01); *B05C 1/0817* (2013.01); *B65C 2009/0078* (2013.01)
USPC ..... 427/207.1; 118/261; 118/413; 118/419; 156/578

(58) Field of Classification Search

CPC ..... B65C 9/2269; B65C 2009/0078; B42C 9/0012; B42C 9/0006; B05C 5/0204; B05C 5/0208; B05C 1/0813; B05C 1/0817; B05D 1/28
USPC ..... 118/413, 419, 261; 427/207.1; 156/578; 101/363, 364
See application file for complete search history.

(56) References Cited

U.S. PATENT DOCUMENTS 4,009,657 A * 3/1977 Bonanno et al. ..... 101/157
4,693,210 A 9/1987 DiFrank ..... 118/259
(Continued)

FOREIGN PATENT DOCUMENTS

CN 101466603 a 6/2009 ..... B65C 9/2247
DE 1146435 10/1959
(Continued)

OTHER PUBLICATIONS

Extended European Search Report issued in related application No. 12168944.2, dated Sep. 4, 2012 (7 pgs).
(Continued)

*Primary Examiner* — Laura Edwards
(74) *Attorney, Agent, or Firm* — Hayes Soloway P.C.

(57) ABSTRACT

A device for applying glue onto labels, includes a drum rotatable about a predetermined rotational axis and, a glue application unit for applying glue onto an external surface of the rotatable drum. The glue application unit includes a receiving space for receiving the glue as well as a supply unit for applying the glue to the receiving space which is arranged relative to the drum such that any glue present in the glue application unit contacts the drum in a predetermined contact area. The glue application unit includes a first wall element, which contacts the drum during operation, and a second wall element arranged behind the first wall element in the direction of movement of the drum and which also contacts the drum. At least one wall element is elastically pressed against the external surface of the drum.

12 Claims, 5 Drawing Sheets

(51) Int. Cl.

| | |
|---|---|
| ***B05C 1/08*** | (2006.01) |
| ***B05C 5/02*** | (2006.01) |
| ***B05D 1/28*** | (2006.01) |
| *B65C 9/00* | (2006.01) |

(56) References Cited

U.S. PATENT DOCUMENTS

| | | | | |
|---|---|---|---|---|
| 6,554,900 | B1 * | 4/2003 | Aydin et al. | 118/211 |
| 8,028,496 | B2 * | 10/2011 | Deckert et al. | 53/136.1 |
| 2009/0095372 | A1 | 4/2009 | Deckert et al. | 141/270 |

FOREIGN PATENT DOCUMENTS

| | | | |
|---|---|---|---|
| DE | 4006837 | 4/1991 | B65C 9/22 |
| DE | 20220132 | 4/2004 | B65C 9/22 |
| DE | 102006017365 | 10/2007 | B05C 1/08 |

OTHER PUBLICATIONS

Notice under Article 94(3) EPC issued in related application No. 11166838.0, dated Aug. 30, 2012 (5 pgs).
European Search Report, dated Oct. 11, 2011 (6 pgs).
European Communication, Appln No. 12 168 944.2-1707dated Sep. 2, 2013 (6 pages) no translation.
European Communication, Appln. No. 11 166 838.0-1707 dated Mar. 21, 2013 (5 pgs) no translation.
European Communication, Appln. No. 11 166 838.0-1261 dated Aug. 3, 2012 (10 pages) no translation.
Chinese Notification of 1st Action, Appln No. 201110131563.0, mailing date Aug. 2, 2013 Eng. Text (9 pgs).

* cited by examiner

DEVICE AND METHOD FOR APPLYING GLUE

BACKGROUND OF THE INVENTION

The present invention relates to systems for labelling containers and in particular also to devices for applying glue onto labels. It is known in the area of beverage producing industries to provide containers with labels. In this respect it is known on the one hand to use labels that are designed to be self-adhesive as well as labels onto which glue is initially applied so as to subsequently attach the labels provided with glue to the containers. In the latter type of labels, so-called glue drums are known which are used for applying glue onto the rear sides of the labels. In the prior art, the glue is applied by means of a so-called glue scraper on a drum, said glue scraper resting on the glue drum in a pivotable and tangential manner. In order to reliably fulfil its function, a high degree of accuracy with regard to the position between the glue drum and the glue scraper is required here. It is also possible here for the glue scraper to be mechanically advanced onto the glue drum. Further, in the direction upstream of a glue drum of this type a label scraper is usually provided which has the function of rejecting labels that are drawn into the gluing unit. These components make the cleaning of and access to the gluing unit very difficult for the operator.

The present invention is therefore based on the object of providing a glue application device which reduces the requirements in respect of the above-mentioned accuracy.

SUMMARY OF THE INVENTION

An apparatus according to the invention for applying glue onto labels comprises a drum that is rotatable about predetermined rotational axis as well as a glue application unit for applying glue onto an external surface of the rotatable drum. Here, the glue application unit includes a receiving space for receiving the glue as well as a supply unit for supplying glue to the receiving space. Further, the glue application unit is arranged in such a way that any glue present in the glue application unit comes into contact with the drum in a predetermined contact area, with said glue application unit having a first wall element which contacts the drum during operation, as well as a second wall element which is arranged behind the first wall element in the direction of movement of the drum and which also comes into contact with the drum.

According to the invention, at least one wall element is pressed against the external surface of the drum in an elastic manner or under the effect of a spring force.

In particular, at least one wall element is elastically pressed against the external surface of the drum during operation of the device. A wall element is to be understood in particular as an element which extends in a plane or a pulling direction and which is part of the glue application unit, but which comes into contact with the glue drum. As a result of this elastic contact between the wall element and the roller, an improved sealing of the receiving space is achieved. Also, in this way a more uniform application of the glue on the drum may be enabled. Advantageously, the wall contacts the drum over the entire extension of said wall, which means in particular its extension in the longitudinal direction or the direction of the rotational axis of the drum.

Thus, the glue application unit includes in particular a hollow chamber that may be filled with glue. By means of the two wall elements or separate doctor blades, the glue layer is pulled off from the glue drum. Due to the geometry and the mechanical properties of these doctor blades, any run-out errors are compensated, with the glue pattern remaining unchanged.

Advantageously, both wall elements are pressed against the external surface of the drum especially in an elastic manner. A wall element that is arranged behind the first wall element in the direction of movement of the drum is to be understood to mean that in the working operation at a predetermined point in time, these will rest on two predetermined areas of the external wall of the drum, said areas being offset from one another in the circumferential direction of the drum. Between the two contact areas, the receiving space for receiving the glue is formed.

Advantageously, therefore, at least one wall element and preferably both wall elements delimit the receiving space. In this way, the number of components of the device can be further reduced and the accessibility of the system is enhanced.

In a further advantageous embodiment, the external surface of the drum has a structured surface at least in sections. This structured surface allows the application of the glue onto the external surface of the drum to be improved. Thus, for example, the external surface may have indentations extending in the direction of the axis of the glue drums, which indentations are in one embodiment for example homogeneously distributed on the external surface of the drum. It would further be possible for these indentations or structures to be provided only in some areas in the circumferential direction of the drum. Advantageously, these indentations have a depth between 0.02 and 0.08 mm and preferably between 0.03 and 0.05 mm. This embodiment of these indentations was described in detail in the so far unpublished German Patent Application DE 10 2010 000 182.1. The disclosure of this patent application is included by reference in the disclosure of the present patent application.

In a further advantageous embodiment, the external surface of the drum also has a smooth surface at least in sections. Preferably, it is also possible here that, as mentioned above, the smooth and the structured surfaces alternate in the circumferential direction of the drum. In this way it is possible to apply glue during operation only onto predetermined areas of the surface (in particular the structured areas), but not onto other areas (in particular the smooth areas).

In a further advantageous embodiment, the device has a first sealing means which seals the receiving space against the environment and which adjoins to the sealing space in the direction of the rotational axis. Here, the sealing means advantageously contacts the external surface of the drum in a predetermined sealing area. Preferably, the resulting receiving space for the glue will therefore be sealed by means of said sealing means towards the bottom and particularly preferably also towards the top.

Advantageously, the external surface of the drum has a smooth external surface in the sealing area. In this way, the sealing effect between the drum and the sealing means may be improved.

It is further possible for the glue application unit and/or the glue scraper to be implemented with a heater or without a heater. To simplify the cleaning process, the glue application unit may here be completely removed or simply swung out.

Therefore, apart from the above-mentioned first sealing means, a second sealing means is advantageously also provided, with the receiving space (in particular in the direction of the rotational axis of the drum) advantageously being arranged between these two sealing means.

In a further advantageous embodiment, the wall elements extend substantially along a rotational axis of said drum. In this connection it is in particular possible for the wall elements to be arranged parallel to said rotational axis.

In a further advantageous embodiment, the first wall element extends in a direction which includes an angle with a geometrical tangent on the drum, which is between 0° and 70°, preferably between 10° and 60° and particularly preferably between 10° and 30°. Thus, the wall element rests against the drum particularly in the contact area under a very shallow angle, as a result of which any frictional wear between the drum and the wall element is minimised even under the effect of a spring force. Thus, the wall element may be an elastic wall element, which may be made for example from an elastic material and which will press against said drum. As a result of this angular embodiment, scraping and/or applying glue onto the drum is facilitated.

In a further advantageous embodiment, the glue application unit includes a discharge unit for discharging glue from the receiving space. This discharge unit is preferably arranged upstream of the supply unit. By means of this approach it can be ensured that the glue present inside the receiving space will always be under a substantially constant pressure.

In a further advantageous embodiment, the glue application unit is implemented to be replaceable. This means that it is in particular possible for a support for accommodating the glue application unit to be provided. It is also possible to use glue application units of different heights. This approach makes it possible to replace the unit with an identical one or with a new variant of a glue application unit. The glue scraper may be provided with different geometries of the doctor blades. Thus, for example, it is conceivable to use a glue scraper as part of an assembly. In the case of labels with a low height, a correspondingly low glue scraper or a lower glue application unit may be used, and in this way glue contamination and glue consumption may be minimised.

In a further advantageous embodiment, the glue application unit is arranged to be in a fixed position in its mounted condition, i.e. in particular not adjustable in relation to the drum. This means that in contrast to the prior art, this embodiment exactly provides for the glue application unit not to be adjustable in relation to the drum. The compensation of for example surfaces with unevenness on the glue drum is, as mentioned above, achieved by providing elastic walls or doctor blades.

In a further advantageous embodiment, the device includes a sensor unit which determines a position of the glue application unit in relation to the drum. In this way, this sensor can be used to poll the position of the glue application unit. The glue flow can be controlled as a function of the position. Here, too, for example when a label is pulled into the glue unit, the operator may be prompted to rectify the fault. Apart from that, it may also be provided for the machine not to start until after a label has been removed.

It is further possible to provide a label rejector, which is particularly preferably disposed directly on the glue application unit. In this way, an altogether error-tolerant and flexible scraper system may be provided at low costs.

The sensor unit mentioned above, which determines the position of the glue application unit in relation to the drum, may here determine the position for example by optical means, but also for example via the electric resistance between the wall elements and the drum.

In a further advantageous embodiment, the device includes a rotatable cylinder, on the lateral surface or external surface of which the labels may be fixed, with the rotatable drum advantageously contacting the labels disposed on the lateral surface in sections. In this way, the glue may be applied to the rear side of the labels. Advantageously, the labels are fixed to the lateral surface of the rotatable cylinder using vacuum.

The present invention is further directed to a method for applying glue onto a glue drum, wherein glue is fed in one step to a receiving space formed by a glue application unit.

Further, a drum is rotated about a predetermined rotational axis, with the glue application unit being arranged in such a way that any glue present in the glue receiving space contacts the external surface of the drum. Further, the glue is applied by means of a wall which delimits the receiving space, said wall being elastically pressed against the external surface of the drum.

BRIEF DESCRIPTION OF THE DRAWING

Further advantages and embodiments will become evident from the attached drawings, wherein.

DETAILED DESCRIPTION OF THE DRAWINGS

Figure 1:
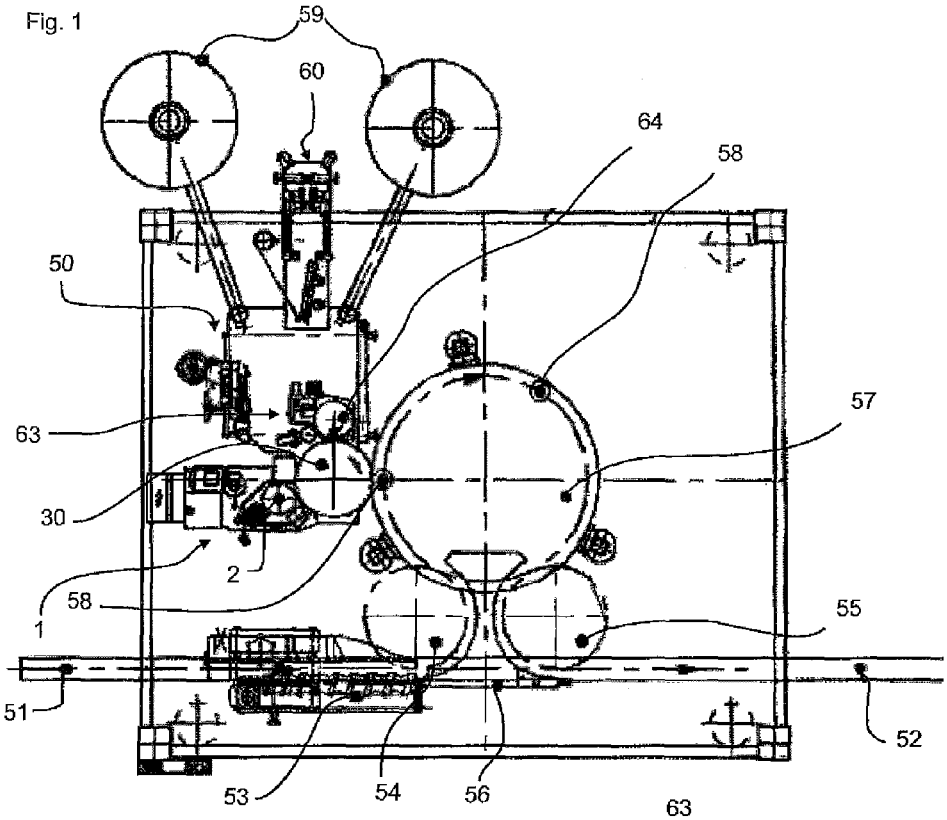
FIG. 1 shows a device for attaching labels to containers.

FIG. 1 shows a schematic top view of a labelling machine that allows labels to be attached continuously with high efficiency onto articles which are continuously supplied in a single-lane row. The articles may here be cans, glass bottles, PET bottles or the like.

The labelling machine 50 includes an infeed conveyor 51, an inlet star wheel 54 with an upstream dividing worm 53, a guiding arc 56, a carousel 57 with a plurality of rotary plates 58 arranged in equal intervals on a common pitch circle, an outlet star wheel 55 and an outfeed conveyor 52. The transport elements moving the articles through the labelling machine can be continuously driven in a manner synchronous in respect of speed and position.

In the circulation area between the inlet star wheel 54 and the outlet star wheel 55, a labelling unit 50 for applying labels onto the articles is provided on the outer periphery of the carousel 57. The labelling unit 50 includes two label roll receptacles 59 and a splicing station 60 positioned therebetween, a cutting unit 63, a glue unit 1 having a vacuum cylinder 30 for transferring a pre-cut label having glue applied to its leading and trailing edges onto a passing article. The process of labelling an article is carried out in detail as follows:

The article supplied from the infeed conveyor 51 is introduced into the inlet star wheel 54 in an appropriate position in association with the laterally disposed dividing worm 53 and is pushed by said inlet star wheel in cooperation with the guiding arc 56 located opposite thereto in a continuous movement onto a rotary plate of the rotating carousel 57. There, the article is axially clamped on a rotary plate rotatable therewith by a centring bell (not shown) which is controlled relative to the rotary plate and can be lifted and lowered, and is fed in by the circulatory movement of the carousel 57 tangentially towards the vacuum cylinder 30 of the labelling unit.

At the same time, the label strip is pulled off from a label strip roll 59 in a controlled manner, is guided past a sensor (not shown here) for detecting any print marks or the print pattern and is cut in the cutting unit 63 associated with the sensor in accordance with the printing pattern or the crop marks. The severed label, which is located on the rotating vacuum drum 64 with the printing pattern facing outwards during the cutting process, is transferred to the vacuum cylinder 30 after the severing process, from where it is guided past the glue drum 2 with its rear side facing outwards and is provided with glue in a predetermined type-dependent area of the label. This label provided with glue is supplied tangentially towards the carousel 57 on which the articles are located. The label with the glue applied thereon comes in contact with the article and is rolled onto said article by a suitable movement of this article.

Upon passing the labelling unit and upon completion of the attachment of the label onto the article, the labelled article then arrives at the outlet star wheel 55 and is transferred onto the outfeed conveyor 52.

Figure 2:
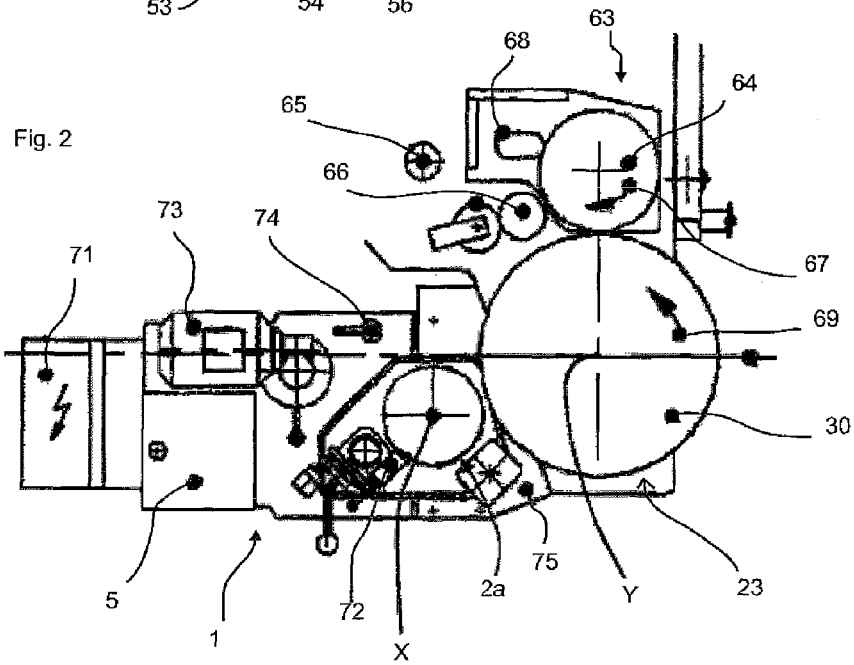
FIG. 2 shows a detailed view of the device from FIG. 1.

FIG. 2 shows a schematic top view of the cutting unit 63 and of the glue unit 1, which is illustrated in a patent application that was recently filed by the applicant. The label strip pulled off from the label strip roll 59 is fed via an idle roller 65 and the roller pair 66 to the cutting unit 63. Here, the label strip rests against the vacuum drum 64 that rotates in the direction of the arrow 67 and is cut by a severing element 68 in correspondence with the crop marks or the printing pattern.

These label pieces are transferred to the vacuum cylinder 30 which rotates in the direction of the arrow 69. The labels thus rest on the lateral surface 23 of the vacuum cylinder 30. The vacuum cylinder 30 rotates about the Y axis. The lateral surface 23 of the vacuum cylinder 2 has elements (not shown) which respectively receive the beginning and/or the end of the label piece. It can be seen from this fact that in the case of different label lengths, other vacuum cylinders will have to be used in order to match the elevations to the label lengths.

During the movement of the label pieces located on the lateral surface 23 of the vacuum cylinder 30 past the glue drum 2, the elevations of the drum cause the respective label pieces to come into contact with the glue drum in a predetermined area, so that these are provided with glue at the predetermined positions. These strips of glue are needed to glue the label pieces onto the articles to be labelled. The transfer of the label pieces provided with strips of glue is carried out in the position where the rotary plates of the carousel 57 come into contact with the lateral surface 23 of the vacuum cylinder.

In order to be able to provide the label piece as just described with strips of glue, a glue unit 1 is required. The glue unit consists of a glue tank 5, if necessary a glue heater 71, a gluing strip 72, a glue pump 73 and quick-clamping elements 74. The hot glue which was supplied to the glue tank 5 and was liquefied by the glue heater 71 so that it can be processed is pumped by the glue pump 73 to the glue tank 5 and is fed by means of the glue drum 2 to the external surface 2*a* of the latter. The gluing strip 72 is fed so close to the glue drum 2 that it will remove any excess glue around the axis of the glue drum during rotation of the glue drum 2.

The components just described, which are associated with the glue unit 1 are mounted on a glue unit base plate 75. The glue unit base plate 75 can be integrated in its entirety into the labelling unit. To this end, the glue unit 1 is placed against two strips (not shown here) of the labelling unit and is removed from the labelling unit using a quick-clamping element on the glue unit base plate 75 together with all its components and is replaced with another glue unit 1.

Figure 3:
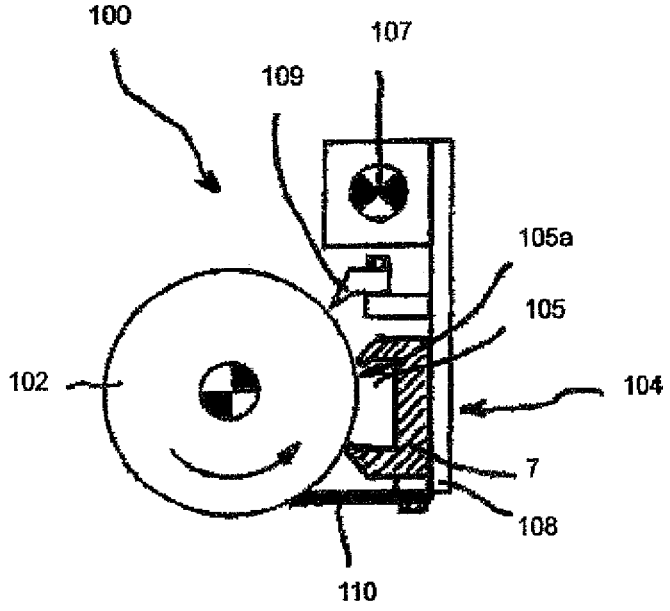
FIG. 3 shows a device for applying glue according to the prior art.

FIG. 3 shows a device for applying liquids in labelling machines according to the prior art. This device 100 includes a drum 102 onto which glue is to be applied. Reference numeral 105 relates to a supply chamber or a receiving space, in which glue is present, with an opening 105*a* being further provided which opens from this supply chamber 105 towards the drum 102. Reference numeral 110 relates to a scraper which in the working position has a smaller radial distance from the drum than the actual glue application unit 104. Through this opening 105*a*, substantial amounts of glue, partly also unintentionally, may exit from the supply chamber 105.

Reference numeral 107 in FIG. 3 relates to an axis which is parallel to the rotational axis of the glue drum 102 and in relation to which a housing 7 is pivotably arranged via a support 108. Reference numeral 109 identifies a gluing strip.

Figure 4:
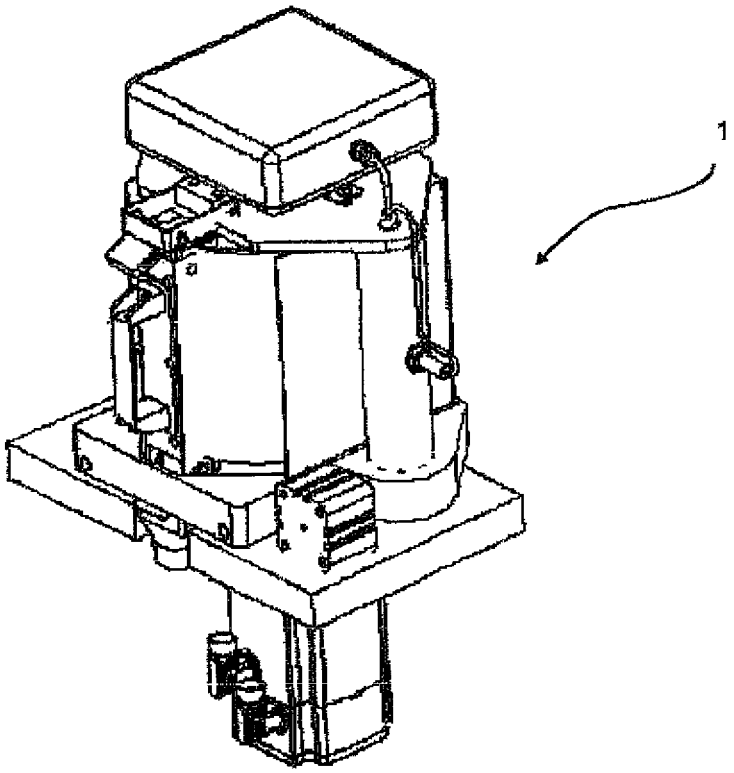
FIG. 4 shows a perspective view of a glue unit.
Figure 5:
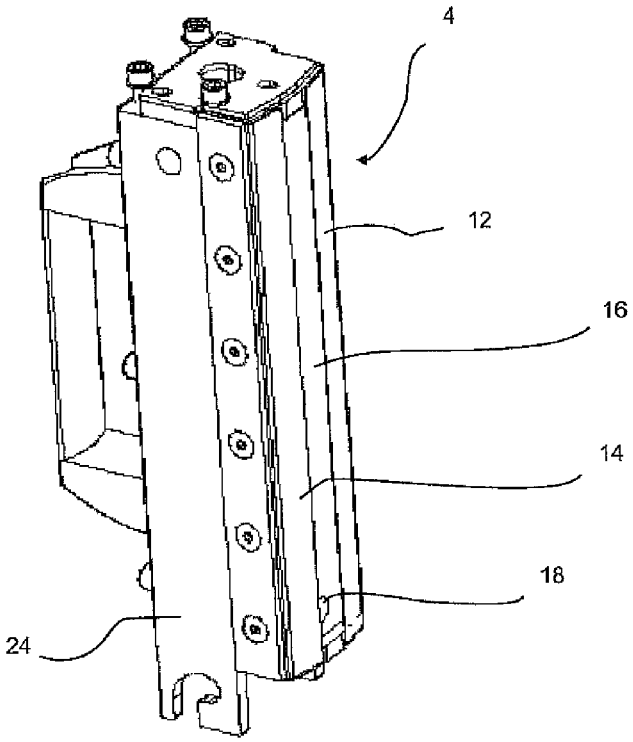
FIG. 5 shows a view of a glue application unit.

FIG. 4 shows a view of a glue unit 1 according to the invention. This glue unit includes a glue application unit 4 shown in FIG. 5. This glue application unit 4 includes here a receiving space 16 for receiving the glue, which glue can be supplied via a supply unit 18 to the receiving space 16. Reference numeral 12 identifies a first wall element which is here part of the glue application unit 4, and reference numeral 14 identifies a second wall element. The glue application unit 4 is disposed on a support 24. This support 24 in turn may be disposed in a fixed position relative to the drum 2.

Figure 6:
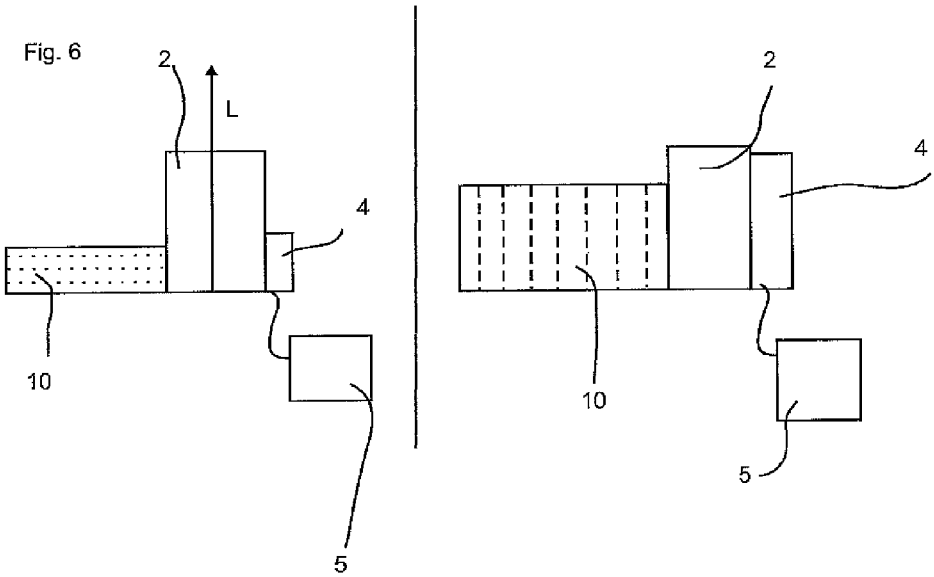
FIG. 6 shows two schematic views for illustrating glue application units.

FIG. 6 shows two generally schematic views for illustrating a use of glue application units 4. Here, too, reference numeral 2 again relates to a glue drum and reference numeral 4 respectively relates to the glue application unit. Reference numeral 5 respectively identifies a glue tank in order to supply the glue to the glue application unit 4. In the case of the left-hand part in FIG. 6, a comparatively small label 10 is fed to the glue drum, and correspondingly also the glue application unit is relatively short in the longitudinal direction L of the glue drum. In the case of the right-hand part of the figure, a comparatively wide label 10 is fed to the glue drum 2, and correspondingly also a longer glue application unit 4 is used.

Figure 7:
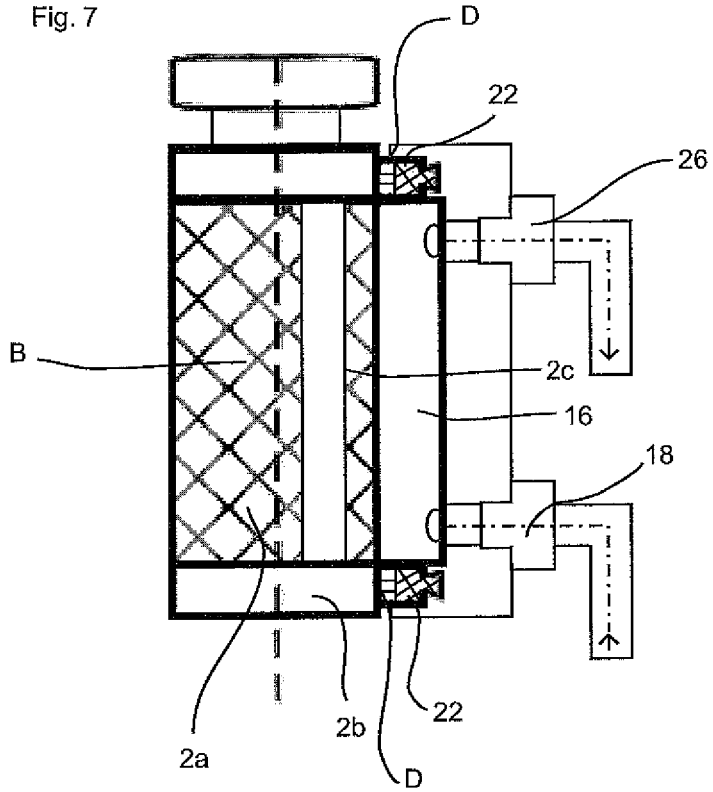
FIG. 7 shows a schematic sectional view of a glue application unit including a drum.

FIG. 7 shows a lateral view for illustrating the invention. Here, again, the drum 2 is shown which has a surface 2*a* that is structured here. In the lower and upper areas of the drum, non-structured or smooth surface areas 2*b* are provided. Apart from that, non-structured areas 2*c* may be provided also in the circumferential direction of the drum. The area in which the glue contacts the drum, is contact area B.

The glue application unit 4 has here two sealing means which respectively rest against the non-structured or smooth areas 2*b* of the glue drum. These sealing means may here be PTFE seals. The areas in which the sealing means 22 rest against the glue drum are also the respective sealing areas D.

Reference numeral 18 identifies a supply unit for supplying glue and reference numeral 26 identifies a return unit or a discharge unit for the glue. As mentioned above, the discharge unit for the glue is here disposed upstream of the supply unit 18. Further, the glue application unit 4 can be heated, so that the glue in the receiving space 16 is also heated.

Figure 8:
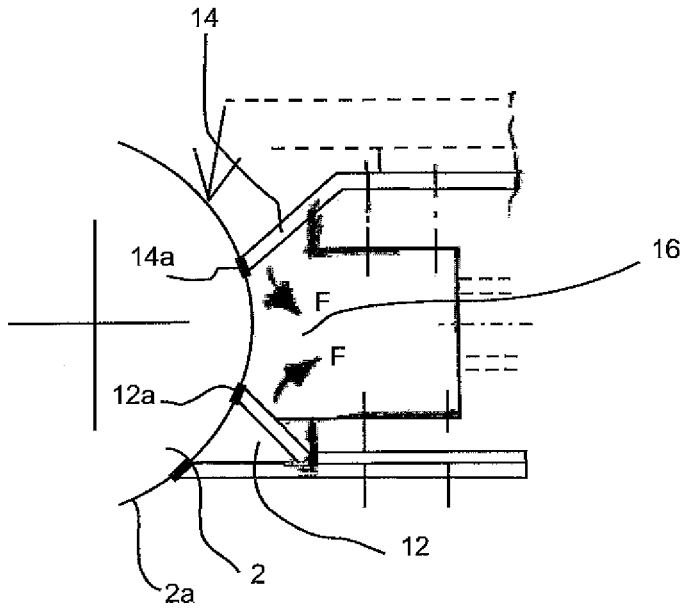
FIG. 8 shows a top view of the illustration shown in FIG. 7.

FIG. 8 shows a further view of the device according to the invention. What can be seen here again are the receiving space 16 as well as the first wall element 12 and the second wall element 14, each of which rest on the drum 2. However, the angles under which the wall elements are disposed here relative to the tangent of the drum are represented too large. Further, support pieces 12*a* or 14*a* may be disposed on the wall elements, which press against the external surface 2*a* of the drum. In this case, more specifically, even the two end pieces 12*a* and 14*a* could constitute the actual wall elements. It can be seen, however, that the two wall elements 12 and 14 delimit here the receiving space in the circumferential direction of the drum, so that glue can only exit in a targeted manner as a result of the rotation of the drum 12.

Figure 9:
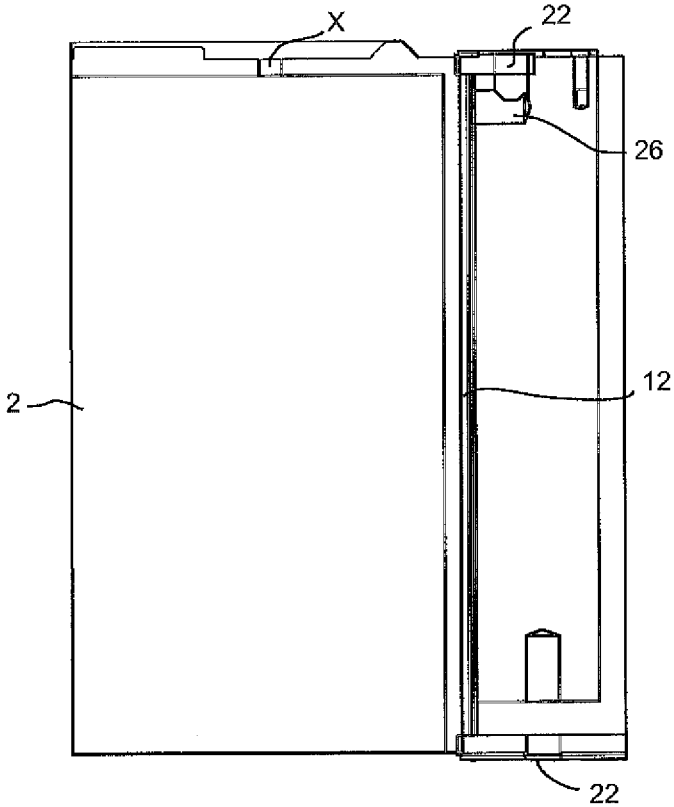
FIG. 9 shows a further view of a drum with a glue application unit.

FIG. 9 shows a further lateral view of an arrangement according to the invention. What can be seen here again are the glue drum 2 as well as the two sealing means 22 which rest against the upper and lower edges of the glue drum 2.

Figure 10:
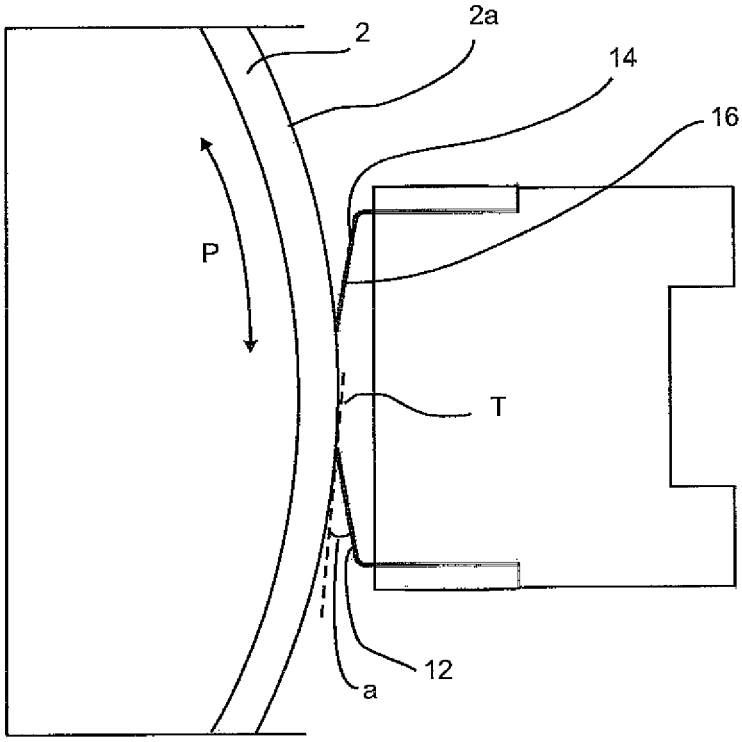
FIG. 10 shows a top view of the illustration from FIG. 9.

FIG. 10 shows another view from the top onto a device according to the invention. What can be seen here in particular are the very shallow angles a, under which the two wall elements rest on the external surface 2*a* or the tangent T thereof. What can further be seen is that the receiving space 16 is largely also disposed behind the two wall elements 14 and 12. These two wall elements are here—as mentioned in the beginning—implemented to be elastic and therefore rest against the external surface 2*a* of the drum 2 with a predetermined spring force.

The glue application unit is here supported in a pivotable manner and may advantageously also be implemented to be pneumatically switched off. In order to replace the glue drum 2, for example for cleaning or for changing the glue type, a heating may be swung into a predetermined changing position. By means of some thermally insulated protection, any risk to the operator will advantageously be avoided. A position of the glue application unit can particularly preferably be multi-dimensionally adjusted in order to compensate for any alignment errors relative to the vacuum cylinder (not shown). Apart from that, also an integrated cable guide may be provided, which is used for protecting against glue contamination. Instead of using a module with a glue drum, also a module with a spray system may be attached via a predetermined interface.

Reference character P identifies the rotational direction of the glue drum 2. In contrast to the devices known from the prior art, a rotation of the drum is possible here in both rotational directions. By means of this it is achieved that here two wall elements 12, 14 are provided (with one wall element being provided upstream of the glue application point and the other wall element downstream of the glue application point, depending on the running direction), which respectively include support pieces 12*a*, 14*a*. More specifically, in this way a chamber is generated which allows an improved glue application. Also, as a result of the elastic effect of these wall elements or the support pieces, a correct adjustment of the wall elements 12, 14 relative to the glue roller 2 will always be achieved independently from the temperature generated or from the wear of the materials used. In this way, an improved glue application is ensured.

The applicant reserves the right to claim all of the features disclosed in the application documents as being essential to the invention, in as far as they are novel over the prior art either individually or in combination.

LIST OF REFERENCE NUMERALS

1 Glue unit, device
2 Glue drum
2*a* Lateral surface, structured surface, external surface
2*b* Smooth surface areas
2*c* Non-structured areas
4 Glue application unit
5 Glue tank, supply chamber
7 Housing (prior art)
12 First wall element, drum
12*a* Support pieces, end pieces
14 Second wall element
14*a* Support pieces, end pieces
16 Receiving space
18 Supply unit
22 Sealing means
23 Lateral surface of the vacuum cylinder
24 Support
26 Return unit
30 Vacuum cylinder
50 Labelling machine
51 Infeed conveyor
52 Outfeed conveyor
53 Dividing worm
54 Inlet star wheel
55 Outlet star wheel
56 Guiding arc
57 Carousel
58 Rotary plate
59 Label roll receptacles, label strip roll
60 Splicing station
63 Cutting unit
64 Vacuum drum
65 Idle roller
66 Roller pair
67 Arrow
68 Severing element
69 Arrow
71 Glue heating
72 Gluing strip
73 Glue pump
74 Quick-clamping element
75 Glue unit baseplate
100 Device (prior art)
102 Drum (prior art)
104 Glue application unit (prior art)
105 Supply chamber (prior art)
105*a* Opening (prior art)
107 Axis (prior art)
108 Support (prior art)
109 Gluing strip (prior art)
110 Scraper (prior art)
a Shallow angle
B Contact area
D Sealing area
L Longitudinal direction of the drum
T Tangent
X Rotational axis of the drum
Y Rotational axis of the vacuum cylinder
P Rotational direction of the glue drum 2

The invention claimed is:

1. A device for applying glue onto labels, comprising a drum rotatable about a predetermined rotational axis (X), including a glue application unit for applying glue onto an external surface of the rotatable drum, said glue application unit including a receiving space for receiving the glue as well as a supply unit in order to supply the glue to the receiving space configured to be filled, and a discharge unit for discharging glue from the receiving space, said glue application unit being arranged relative to the drum in such a way that any glue present in the glue application unit contacts the drum in a predetermined contact area (B), said glue application unit including a first wall element, which contacts the drum during operation as well as a second wall element which is arranged behind the first wall element in the direction of movement of the drum and which also contacts the drum, wherein the first and the second wall elements are elastically pressed against the external surface of the drum, the first and the second wall elements each having an end support piece whereby to delimit and seal the receiving space, wherein the glue is supplied to the drum from the first wall element to the second wall element, and wherein the glue resent inside the receiving space is always under substantially constant pressure.

2. The device as claimed in claim 1, wherein the external surface of the drum includes a structural surface at least in sections.

3. The device as claimed in claim 2, wherein the receiving space for the glue is sealed by the first seal adjacent a bottom of the space.

4. The device as claimed in claim 3, wherein the receiving space for the glue is also sealed by a second seal adjacent a top of the space.

5. The device as claimed in claim 1, wherein the external surface of the drum includes a smooth surface at least in sections.

6. The device as claimed in claim 5, wherein the external surface of the drum has a smooth external surface in the sealing area (D).

7. The device as claimed in claim 1, wherein the device includes a first seal that seals the receiving space against the environment and that adjoins to the receiving space in the direction of the rotational axis (X), said seal contacting the external surface of the drum in a sealing area (D).

8. The device as claimed in claim 1, wherein the first wall element extends in a direction that includes an angle with a geometrical tangent (T) on the drum, which is between 0° and 70°.

9. The device as claimed in claim 1, wherein the glue application unit is disposed in a fixed position relative to the drum.

10. The device as claimed in claim 1, wherein the first wall element extends in a direction that includes an angle with a geometrical tangent (T) on the drum, which is between 0° and 70°, 10° and 60°.

11. The device as claimed in claim 1, wherein the first wall element extends in a direction that includes an angle with a geometrical tangent (T) on the drum, which is between 10° and 30°.

12. A method for applying glue onto labels by a glue drum, including the following steps:

supplying the glue to a receiving space formed by a glue application unit comprising a drum rotatable about a predetermined rotational axis (X), including a glue application unit for applying glue onto an external surface of the rotatable drum, said glue application unit including a receiving space for receiving the glue as well as a supply unit in order to supply the glue to the receiving space, and a discharge unit for discharging glue from the receiving space configured to be filled, said glue application unit being arranged relative to the drum in such a way that any glue present in the glue application unit contacts the drum in a predetermined contact area (B), said glue application unit including a first wall element, which contacts the drum during operation as well as a second wall element which is arranged behind the first wall element in the direction of movement of the drum and which also contacts the drum, rotating a drum about a predetermined rotational axis (X), wherein the glue application unit is arranged in such a way that any glue present in the glue receiving space contacts the external surface of the drum, applying the glue to a wall delimiting the receiving space, wherein the first and the second wall elements are elastically pressed against the external surface of the drum, the first and second walls elements each having an end support piece whereby to delimit and seal the receiving space, wherein the glue is supplied to the drum from the first wall element to the second wall element, wherein the glue present inside the receiving space is always under substantially constant pressure and wherein the drum applies glue onto the label.

* * * * *